US006562196B1

(12) United States Patent
Huovila et al.

(10) Patent No.: US 6,562,196 B1
(45) Date of Patent: May 13, 2003

(54) METHOD FOR OPTIMIZING THE DEGREE OF FLOCCULATION

(75) Inventors: Jyrki Huovila, Muurame (FI); Juha S. Kinnunen, Jyväskylä (FI); Hannu Korhonen, Jyväskylä (FI); Mari Taipale, Jyväskylä (FI); Ari Puurtinen, Jyväskylä (FI); Pekka Pakarinen, Jyväskylä (FI)

(73) Assignee: Metso Paper, Inc., Helsinki (FI)

( * ) Notice: Subject to any disclaimer, the term of this patent is extended or adjusted under 35 U.S.C. 154(b) by 0 days.

(21) Appl. No.: 09/719,914

(22) PCT Filed: May 28, 1999

(86) PCT No.: PCT/FI99/00467

§ 371 (c)(1),
(2), (4) Date: Dec. 15, 2001

(87) PCT Pub. No.: WO99/66129

PCT Pub. Date: Dec. 23, 1999

(30) Foreign Application Priority Data

Jun. 16, 1998 (FI) ..... 981396

(51) Int. Cl.[7] ..... D21H 23/08

(52) U.S. Cl. ..... 162/198; 162/123; 162/183; 162/DIG. 10; 162/DIG. 11

(58) Field of Search ..... 162/198, 123, 162/183, 322, DIG. 10, DIG. 11

(56) References Cited

U.S. PATENT DOCUMENTS

| | | | | |
|---|---|---|---|---|
| 4,752,356 A | | 6/1988 | Taggert et al. | 162/198 |
| 4,952,280 A | | 8/1990 | Hemel et al. | 162/198 |
| 5,560,807 A | * | 10/1996 | Hauser | 162/183 |
| 5,958,189 A | * | 9/1999 | Begemann et al. | 162/322 |

OTHER PUBLICATIONS

U.S. patent application Ser. No. 08/323,839 filed Oct. 17, 1994.

* cited by examiner

*Primary Examiner*—Peter Chin
(74) *Attorney, Agent, or Firm*—Steinberg & Raskin, P.C.

(57) ABSTRACT

The invention concerns a method for optimizing the degree of flocculation in a headbox. The degree of flocculation is measured continuously from a stock flow ($M_1$)/stock flows by means of a detector ($R_1$) of flocculation, and the detector ($R_1$) transmits a signal to a regulator ($H_1$), which regulates the metering of retention agent (10) and/or fillers (11) and/or auxiliary chemicals (12) into the stock flow ($M_1$)/stock flows continuously on the basis of the signal to an optimal level, which stock flow/flows is/are passed into the headbox ($P_1$).

14 Claims, 2 Drawing Sheets

METHOD FOR OPTIMIZING THE DEGREE OF FLOCCULATION

FIELD OF THE INVENTION

The invention concerns a method for optimizing the degree of flocculation in a headbox and in particular for optimizing the degree of flocculation in layers in a multi-layer headbox.

BACKGROUND OF THE INVENTION

In paper and board machines, the stock is prepared either out of one fresh stock or out of several fresh stocks and introduced into each inlet header along one or several fresh-stock lines out of the same fresh stock or out of different fresh stocks. The necessary chemicals and fillers are added to the fresh stocks as invariable amounts mainly based on the consistency of the white water or on retention, without particular regulation. When a filler agent is applied as layers by means of a retention agent, optimal flocculation or formation of the layers cannot be regulated or measured by means of the present-day methods. As a result of this, an erroneous quantity of a filler or retention agent is easily metered into a layer, because constant variations take place in the properties of the stock and in the conditions, and the momentary need of additives varies. When an excessive amount of retention agent is metered into a certain layer in order to achieve a desired distribution of fillers, there is a risk that the layer concerned is subjected to intensive flocculation, in which case the formation of said layer, and so also the formation of the paper, are clearly deteriorated.

Flocculation is one of the essential phenomena in a papermaking process. It affects both the runability of the machine and the quality of the final product and the control of the formation, which is one of the most important goals of the process of manufacture. Flocculation is understood as gathering of fibres, fines and fillers present in a slurry into flocks. The phenomenon of flocculation can be divided into two separate phenomena, of which one is flocculation of mainly small particles, i.e wood-based and mineral-based fines, in a dilute water suspension, and the other one involves flocculation of fibres in high-consistency suspensions, whereby meshes are formed. Flocculation of small particles usually requires an auxiliary agent, such as a retention chemical, whose effect is based on electrostatic interactions. Flocculation of fines affects the retention of fines and, further, the quality factors of the process and the product dependent on said retention. The mainly mechanical flocculation of fibres is based on the dimensions of the suspended fibres and on the consistency of the suspension. Flocculation of fibres affects the structure of the fibre mesh formed in the wire part and, thereby, for example, the formation. Factors that have a greater effect on flocculation are fibre length, chemicals present in the suspension, consistency of the suspension, and flow rate of the slurry.

As is well known, board is almost always made of two or more separate layers, and a bonding strength between layers is an essential feature of board. The bonding strength between the layers is affected, among other things, by the content of fines on the surfaces of the layers to be combined and by several auxiliary chemicals. Attempts have been made to increase the bonding strength between layers, for example, by spraying starch or some other auxiliary agent that increases the bonding strength directly onto the web or by, from a separate headbox, passing a thin layer of extensively ground chemical pulp onto one of the webs to be joined together. Starch jets deteriorate the runability considerably, block the wires and felts, and contaminate the machines and devices, in which case quite frequent cleaning is necessary because of contamination. The necessary auxiliary agents cannot be added sufficiently selectively, and in most systems a number of separate stock lines are required, in which case the system is heavy and highly expensive to operate. In paper and board machines, so far, precise determination and regulation of the supply of chemicals and additives in compliance with the factual, momentarily varying needs have not been possible, which needs are, of course, affected by the stock that is used and by variation of the operating conditions.

In the Finnish Patent No. 92, 729, a stock feed system for a multi-layer headbox and a method in the operation of a multi-layer headbox are described. According to said system, into each inlet header in the multi-layer headbox, a stock concept is passed, which has been produced out of the same fresh stock by to the fresh stock adding the necessary chemicals and fillers.

In the prior art, regulation of the supply of retention agents has not been examined with the aid of degree of flocculation, nor has the chemistry of the wet end of a paper or board machine been monitored continuously, for which reason precise determination of the need of supply of auxiliary chemicals has not been possible either.

OBJECTS AND SUMMARY OF THE INVENTION

The object of the present invention is a method for application of fillers and retention agents as layers and, at the same time, for regulation of a degree of flocculation optimal for each layer and, thereby, for achieving an optimal flocculation.

It is a further object of the invention to solve the problems involved in the prior art.

The method in accordance with the invention for optimizing the degree of flocculation in a headbox is characterized in what is stated in the patent claims.

Surprisingly, it has been noticed that it is possible to regulate and/or to increase the degree of flocculation in layers in a controlled way directly from the wet end by means of continuous measurement and monitoring of the operation of the retention agents with the aid of overall consistency, ash content, flock number, and filler content and consistency. The measurement can be carried out as continuous so-called on-line measurement by means of a suitable detector of flocculation so that the degree of flocculation is monitored from the headbox stock. From the detector of flocculation, a signal and a feedback are received for each layer when the degree of flocculation is measured layer by layer. In this way it is possible to regulate the metering of retention agent and filler layer by layer based on the on-line measurement of flocculation, and further, the degree of flocculation can be regulated to an optimal level, which results in improved formation of surfaces. The invention can also be used for controlled increase in flocculation, for example for increasing the bulk in a middle layer by increasing the degree of flocculation. In the solution in accordance with the invention, it is possible to use one stock line or several stock lines, and the formation of layers can be carried out functionally in different ways for different layers, depending on the product to be manufactured and on the desired properties of the product. The method can also be used for measurement and regulation of the degree of flocculation in one layer, equally well as in several layers, and measurement and regulation can be carried out either in respect of one layer or in respect of all the layers. A typical example of a single-layer solution is a board machine in which the application of the fibres in layers is measured and regulated by means of a detector of flocculation when each layer comes from a headbox of its own.

In order to control the relative proportion of large flocks in different layers in paper and board, in particular in printing papers and in graphic paperboards, there is also a need to slow down the flocculation of fibres. The tendency of flocculation of fibres can be slowed down and/or prevented by means of deflocculation agents, in which case the formation of the paper can be improved clearly by adding a surface-active agent, favourably a dispersive deflocculation agent or a mixture of such agents. Since the cost of deflocculation agents is rather high, it is ideal to use a deflocculation agent exclusively where the need is most imperative, i.e. for the control of large flocks in the middle layer of paper or board, because, as is well known, in the middle layer in paper the relative proportion of large flocks is considerably higher. In this way it is also possible to improve the quality of the paper that is produced. With specific use of deflocculation agent, the significance of such an agent in increasing the total cost of paper is reduced. When a deflocculation agent is added in the areas only in which it is needed most, formation of the middle layer of a web is also permitted at a consistency higher than in the prior art without deterioration of the properties of formation of the paper. In such a case, it is also possible to obtain important economies in the cost of pumping of stock components. A deflocculation agent is fed preferably into the middle layer of the stock fed from a multi-layer headbox.

The use of dispersive deflocculation agents is in particular suitable for high-consistency web formation, wherein the control of the formation is often problematic otherwise. If the web formation is carried out, for example, at a three-fold consistency, the same percentage of concentration of a chemical in the fibre suspension corresponds to one third of the required dosage of chemical. Further, by means of the metering of chemicals, it is possible to simplify the web formation concept to a significant extent in view of achieving the same level of formation both at normal consistencies and at increased consistencies.

For measurement and regulation of the degree of flocculation, it is favourably possible to use a RM-200 detector of flocculation (Kajaani Oy), which is a system of measurement and regulation. The RM-200 system of measurement and regulation for the wet end is a continuous multi-detector system in whose detectors an optical measurement technology is utilized. The RM-200 flock measurement is based on measurement of the variance of the backscattering signal of the stock, in which connection, as the measurement result, a relative number 0 . . . 100 is obtained, which is called RM degree of flocculation. By means of the detector, from a continuous flow of samples, it is possible to measure overall consistency, filler consistency, degree of flocculation, overall retention, filler retention, and ash proportion. The detector is suitable for all paper and board grades. By means of the detector, it is possible to detect even quick changes in the process, and it can be used as an aid in the making of decisions in locating and looking for interference.

BRIEF DESCRIPTION OF THE DRAWINGS

The invention will be illustrated in the following in more detail with reference to some preferred embodiments of the invention illustrated in the figures in the accompanying drawings, the invention being, however, not supposed to be confined to said embodiments alone.

DETAILED DESCRIPTION OF THE INVENTION

Figure 1:
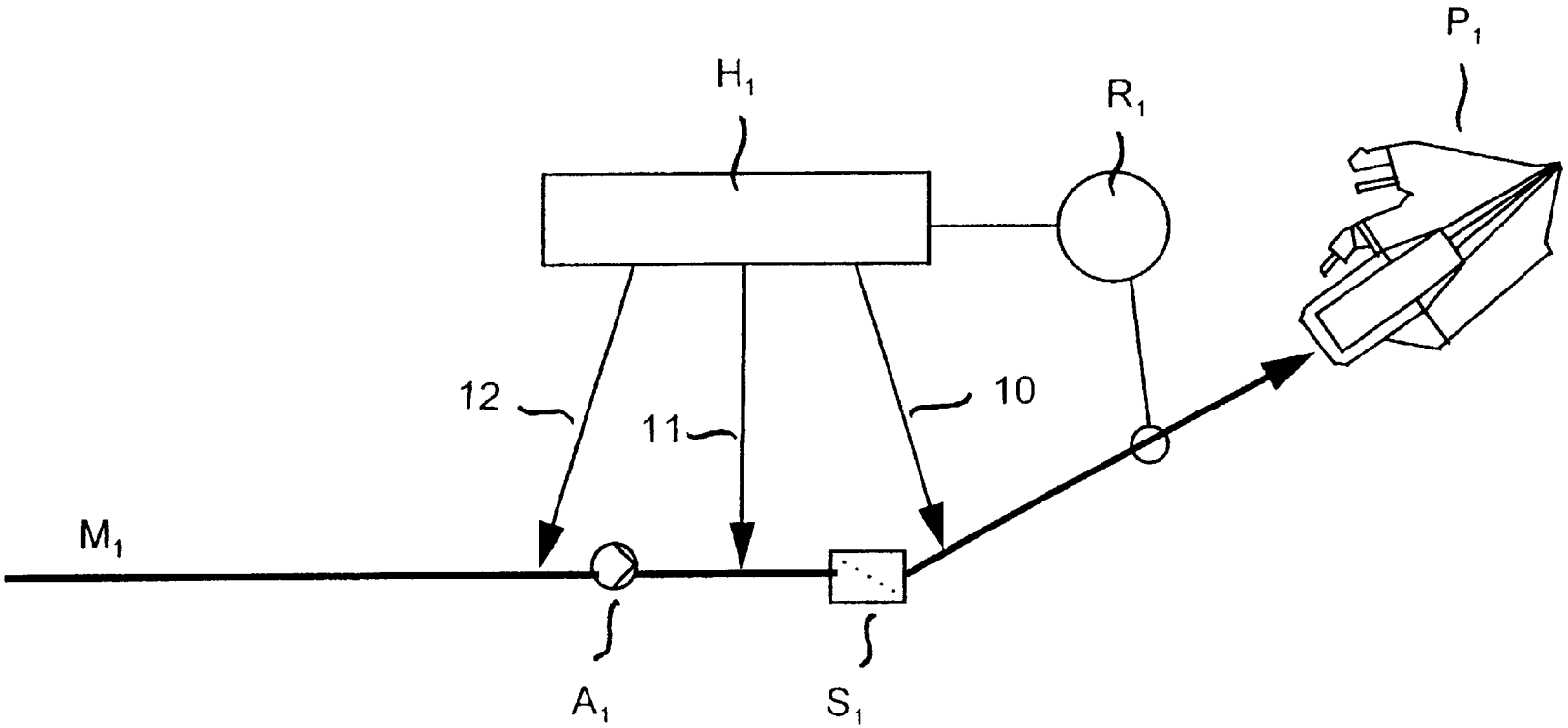
FIG. 1 illustrates a preferred embodiment of the invention, in which a stock flow $M_1$ produced out of one fresh stock is passed into a headbox $P_1$ through a pump $A_1$ and a machine screen $S_1$. By means of a detector $R_1$ of flocculation, the degree of flocculation is measured continuously out of the stock flow $M_1$, and the detector transmits a signal to a regulator $H_1$, which regulates the metering of a retention agent 10 and/or of fillers 11 and/or of auxiliary chemicals 12 into the stock flow continuously to an optimal level on the basis of the signal. The relative sequence 10, 11 and 12 can vary as required.
Figure 2:
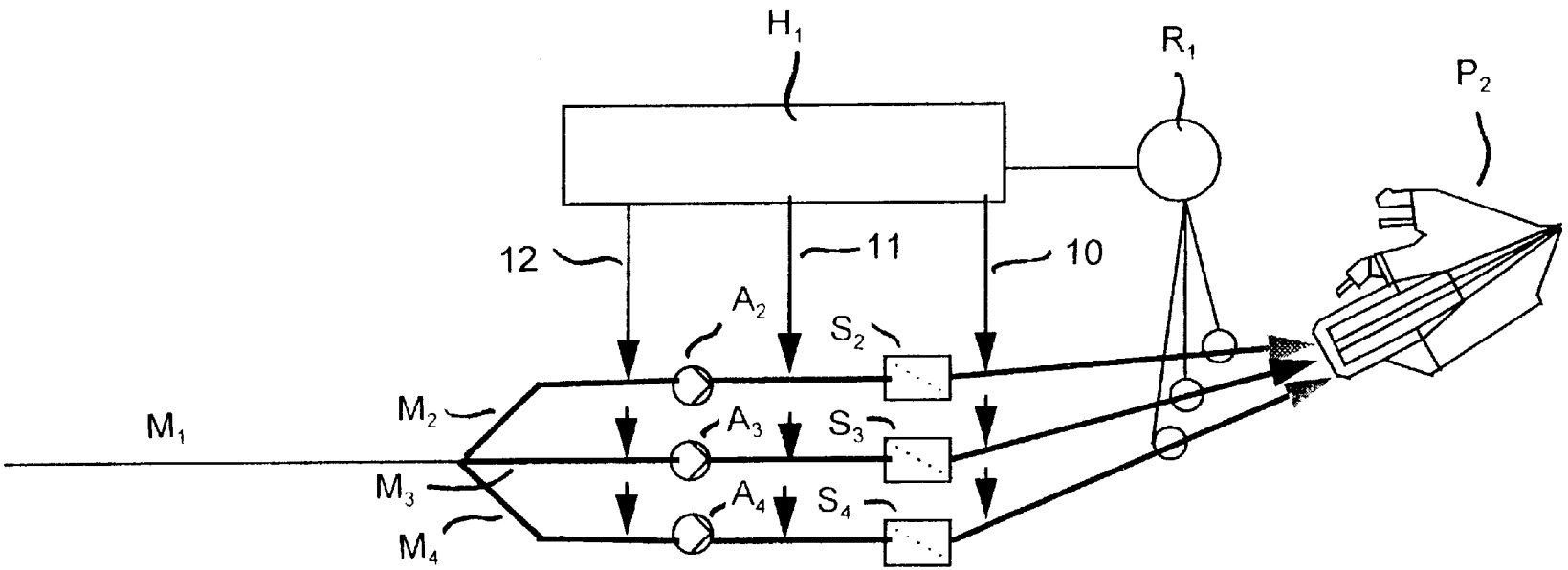
FIG. 2 illustrates a second preferred embodiment of the invention, in which a stock flow produced out of the same fresh stock Ml is divided into three component flows $M_2$, $M_3$ and $M_4$, which are passed by means of pumps $A_2$, $A_3$ and $A_4$ and machine screens $S_2$, $S_3$ and $S_4$ into the headbox $P_2$. By means of the detector $R_1$ of flocculation, the degree of flocculation of each stock flow $M_2$, $M_3$ and $M_4$ is measured continuously, and the detector $R_1$ transmits a signal to the regulator $H_1$, on the basis of which signal the metering of auxiliary chemicals 12, fillers 11 and retention agents 10 into the stock flows is regulated continuously to an optimal level.

The present invention has been described herein with reference to preferred embodiments of the invention however the description provided herein is for illustrative purposes and should not be considered to be exhaustive. It is understood that modifications and variations of the above describe preferred embodiments are possible without departing from the spirit or scope of the present invention.

What is claimed is:

1. A method for optimizing the degree of flocculation in layers in a multi-layer headbox ($P_2$), wherein by means of a detector ($R_1$) of flocculation, the degree of flocculation is measured continuously from each stock flow ($M_2$, $M_3$, $M_4$) which is passed into a headbox ($P_2$), and a signal is transmitted from the detector ($R_1$) to a regulator ($H_1$) which regulates the metering of retention agent (10) and/or fillers (11) and/or auxiliary chemicals (12) into the stock flow(s) ($M_2$, $M_3$, $M_4$) continuously on the basis of the signal to an optimal level, wherein regulating the metering of retention agent (10) and/or fillers (11) and/or auxiliary chemicals (12) into said each stock flow is performed prior to the passing of said each stock flow into said headbox.

2. A method as claimed in claim 1, wherein by means of the detector ($R_1$) of flocculation, the overall consistency and/or the ash content and/or the flock number and/or the filler content and/or the consistency is/are measured continuously from the stock flow(s) ($M_2$, $M_3$, $M_4$) and, based on the results, the metering of auxiliary chemicals (12), retention agents (10) and/or fillers (11) is regulated to an optimal level.

3. A method as claimed in claim 1, wherein the auxiliary chemical is a deflocculation agent or a mixture of such agents.

4. A method as claimed in claim 3, wherein the deflocculation agent is fed into the middle layer of the stock fed out of the multi-layer headbox ($P_2$).

5. A method as claimed in claim 1, wherein the flocculation in a desired layer is increased in a controlled way.

6. A method as claimed in claim 1, wherein the detector ($R_1$) of flocculation is placed in the wet end of a paper or board machine in a stock line passing into the headbox ($P_2$).

7. A method as claimed in claim 6, wherein the detector ($R_1$) of flocculation is placed in a stock line between the machine screen ($S_1$) and the headbox ($P_2$).

8. A method for optimizing the degree of flocculation of a stock in a headbox of a paper machine comprising the steps of:

feeding at least one stock flow into said headbox;

continuously measuring a degree of flocculation of said at least one stock flow prior to an entry of said at least one stock flow into said headbox, wherein said degree of flocculation is measured by means of a detector;

continuously transmitting a signal corresponding to said measured degree of flocculation from said detector to a regulator for regulating a metering of retention agents, fillers and auxiliary chemicals into said at least one stock flow prior to said to the entry of said at least one stock flow into said headbox; and continuously metering said retention agents, fillers and auxiliary chemicals into said at least one stock flow based on said signal.

9. A method as claimed in claim 8, further comprising dividing said stock flow into a plurality of stock flows prior to said measurement of said degree of flocculation; wherein said measuring step comprises measuring a degree of flocculation of each of said plurality of stock flows by means of said detector; wherein said transmitting step comprises transmitting a signal corresponding to said measured degree of flocculation in each of said plurality of stock flows and wherein said metering step comprises metering said retention agents, fillers and auxiliary chemicals into each of said plurality of stock flows based on said signal.

10. A method as claimed in claim 9, wherein said headbox is a multilayer headbox and wherein each one of said plurality of stock flows is fed into said headbox so that each of said stock flows forms one of a plurality of layers of a multi-layer paper web to be produced, and wherein said method further comprising:

feeding into one of said stock flows which forms a middle one of said plurality of layers a deflocculation agent or a mixture of such agents.

11. A method as claimed in claim 9, wherein said auxiliary -chemical is a-deflocculation agent or a mixture of such agents.

12. A method as claimed in claim 9, wherein said headbox is a multilayer headbox and wherein each one of said plurality of stock flows is fed into said headbox so that each of said stock flows forms one of a plurality of layers of a multi-layer paper web to be produced, and wherein said retention agents, fillers and auxiliary chemicals are metered into a selected one of said stock flows such that the flocculation in a selected layer of said multi-layer paper web is increased.

13. A method as claimed in claim 8, further comprising arranging said detector in a stock line which carries said at least one stock flow.

14. A method as claimed in claim 8, further comprising arranging said detector in a stock line which carries said at least one stock flow between a machine screen of said paper machine and said headbox.

* * * * *

UNITED STATES PATENT AND TRADEMARK OFFICE

CERTIFICATE OF CORRECTION

PATENT NO. : 6,562,196 B1
DATED : May 13, 2003
INVENTOR(S) : Huovila et al.

It is certified that error appears in the above-identified patent and that said Letters Patent is hereby corrected as shown below:

Title page,
Item [86], PCT No.: Date, should read -- Dec. 15, 2000 --.

Signed and Sealed this

Twenty-sixth Day of August, 2003

JAMES E. ROGAN
*Director of the United States Patent and Trademark Office*